US011851951B2

(12) United States Patent
Al-Malki et al.

(10) Patent No.: US 11,851,951 B2
(45) Date of Patent: Dec. 26, 2023

(54) WELLBORE SAMPLING AND TESTING SYSTEM

(71) Applicant: Saudi Arabian Oil Company, Dhahran (SA)

(72) Inventors: Bandar Al-Malki, Dhahran (SA); Mohammed Al-Atigue, Dhahran (SA); Asim Al-Khuwayr, Dammam (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 4 days.

(21) Appl. No.: 17/503,830

(22) Filed: Oct. 18, 2021

(65) Prior Publication Data

US 2023/0117471 A1 Apr. 20, 2023

(51) Int. Cl.
*E21B 49/08* (2006.01)
*E21B 47/06* (2012.01)

(52) U.S. Cl.
CPC ..... *E21B 49/081* (2013.01); *E21B 47/06* (2013.01); *E21B 49/088* (2013.01); *E21B 49/0875* (2020.05)

(58) Field of Classification Search
CPC ..... E21B 49/081; E21B 47/01; E21B 47/06; E21B 49/0875; E21B 49/088; E21B 49/084; E21B 49/086
See application file for complete search history.

(56) References Cited

U.S. PATENT DOCUMENTS 2,210,245 A 8/1940 Kimmel
2,781,663 A 2/1957 Maly et al.
2,951,538 A 9/1960 Martin
3,291,219 A 12/1966 Nutter
3,441,095 A 4/1969 Youmans
4,254,830 A 3/1981 Garney et al.
4,274,485 A 6/1981 Fredd
4,538,683 A 9/1985 Chulick
4,625,941 A * 12/1986 Johnson ..... E21B 43/123 417/112
4,690,216 A 9/1987 Pritchard
5,188,183 A * 2/1993 Hopmann ..... E21B 33/12 166/299
5,238,060 A 8/1993 Niehaus et al.
5,249,461 A * 10/1993 Ponder ..... E21B 49/087 166/264
5,287,741 A 2/1994 Schultz et al.
5,293,931 A 3/1994 Nichols et al.
5,460,224 A 10/1995 Schalla et al.
(Continued)

*Primary Examiner* — Tara Schimpf
*Assistant Examiner* — Yanick A Akaragwe
(74) *Attorney, Agent, or Firm* — Bracewell LLP; Constance G. Rhebergen; Keith R. Derrington

(57) ABSTRACT

A system and method for evaluating a wellbore involves drawing fluid from a surrounding formation into an isolated portion of the wellbore, collecting the fluid in the isolated portion, and directing the sampled fluid to surge tanks on surface through a string of coiled tubing. The system and method includes measuring fluid properties, such as density and viscosity; and observing fluid flow characteristics, such as the fluid pressure, the fluid flowrate, and changes in the fluid flowrate. Based on the measured fluid properties and observed characteristics a determination is made if the wellbore is a candidate for a drill stem test.

9 Claims, 5 Drawing Sheets

(56) References Cited

U.S. PATENT DOCUMENTS

| | | | | |
|---|---|---|---|---|
| 5,799,733 | A * | 9/1998 | Ringgenberg | E21B 33/1243 166/147 |
| 6,029,744 | A | 2/2000 | Baird | |
| 7,296,462 | B2 | 11/2007 | Gregory et al. | |
| 7,980,306 | B2 | 7/2011 | Lovell et al. | |
| 8,286,703 | B2 | 10/2012 | Clapp et al. | |
| 8,322,416 | B2 | 12/2012 | Pop et al. | |
| 8,991,483 | B2 | 3/2015 | Irani | |
| 9,303,510 | B2 | 4/2016 | Dumont et al. | |
| 2003/0183422 | A1 | 10/2003 | Hashem | |
| 2007/0284116 | A1 | 12/2007 | Hall et al. | |
| 2013/0062073 | A1 | 3/2013 | Landsiedel | |
| 2017/0022796 | A1* | 1/2017 | Joshi | E21B 43/385 |
| 2017/0089158 | A1* | 3/2017 | Gupta | G01N 33/24 |
| 2019/0203567 | A1 | 7/2019 | Ross et al. | |
| 2019/0271615 | A1* | 9/2019 | Trumbo | G01N 33/1826 |
| 2022/0120178 | A1* | 4/2022 | Jones | G01N 23/223 |

* cited by examiner

WELLBORE SAMPLING AND TESTING SYSTEM

BACKGROUND OF THE INVENTION

1. Field of Invention

The present disclosure relates to a system for sampling fluid from a formation that circumscribes a well, testing in the well, and characterizing formation properties based on the sampling and testing.

2. Description of Prior Art

One known technique of evaluating hydrocarbons in a subterranean formation involves extracting samples of fluid from the formation with a sampling tool that is inside of a wellbore. Analyzing the samples yields information about the sampled fluid, such as its fluid type and properties. Sampling tools are usually deployed into the wellbore on wireline or pipe; and the fluid samples are collected by penetrating the wellbore sidewalls with a probe, and drawing formation fluid through the probe into a container inside the sampling tool. Because sampling tools typically acquire a limited volume of fluid from the reservoir, the information obtained by analyzing fluid gathered a sampling tool does not include reservoir potential or commercial viability.

Reservoir potential and commercial viability of a well are sometimes evaluated by a drill stem test ("DST") by inserting a drill string into the well, isolating a section of the well, and flowing fluid from a surrounding formation into the isolated section. The fluid is directed up the drill string and collected on surface. Results of a DST typically include an expected rate of production, production potential, pressure, permeability, and extend of an oil or gas reservoir. An economic potential of the well is often forecasted based on these measured values. These tests can be performed in both open and cased-hole environments, and provide exploration teams with valuable information about the nature of the reservoir. A DST is usually costly and does not yield answers if hydrocarbons do not flow from the tested zone, or flow for only a limited time. The decision to conduct a DST normally is based on results of formation sampling, which sometimes can be misleading due to sampling volume limitations.

SUMMARY OF THE INVENTION

Disclosed herein is a method for evaluating a subterranean formation and that includes receiving fluid that flows from the formation into a wellbore intersecting the formation (which defines received fluid), collecting the received fluid in a sample tank that is coupled with a tubular string in the wellbore (which defines collected fluid), deploying into the wellbore an end of a string of coiled tubing having a coupling, providing communication between the coiled tubing and the collected fluid inside the sample tank by engaging the coupling with a fitting coupled with the sample tank, transporting an amount of the collected fluid to outside of the wellbore through the coiled tubing, and performing a drill stem test in the wellbore based on a characteristic of one or more of the collected fluid and received fluid. An example characteristic is a fluid property of the collected fluid. In an embodiment, the characteristic is a flow value, such as a flowrate of the received fluid, a change in flowrate of the received fluid, an average flowrate of the received fluid, and combinations. The fluid flowing from the formation into the wellbore is optionally received in an annular space formed between a tubular string and sidewalls of the wellbore and that is bounded by axially spaced apart packers. In an alternative, the amount of the collected fluid transported to outside of the wellbore through the coiled tubing defines sampled fluid, the method optionally further includes storing the sampled fluid in vessels on surface. In one example, the method further includes perforating a sidewall of the wellbore prior to receiving fluid. In an alternative a pressure of the collected fluid transported to outside of the wellbore is substantially at a pressure of fluid within the formation.

Another method for evaluating a subterranean formation is provided and that includes inserting a tubular string having a sample tank into a wellbore that intersects the subterranean formation, collecting fluid in the sample tank that flows from the formation into an annular space between the tubular string and sidewalls of the wellbore, transporting the fluid from the sample tank to outside of the wellbore through coiled tubing, analyzing the fluid outside of the wellbore, and performing a drill stem test inside the wellbore based on analyzing the fluid outside of the wellbore. In an alternative, the method further includes estimating a fluid production rate from the formation based on analyzing the fluid. Analyzing the fluid selectively includes identifying components of the fluid and a flowrate of fluid flowing from the formation into the wellbore. The method further optionally includes storing the fluid transported to outside of the wellbore inside storage tanks mounted on surface.

A system for evaluating a subterranean formation is disclosed and that includes a tubular string selectively inserted into a wellbore formed into the formation, an annular space between the tubular string and sidewalls of the wellbore, a sample tank in communication with the annular space and that selectively receives fluid flowing into the annular space from a formation surrounding the wellbore, and a fitting on the sample tank configured for engagement with coiled tubing that is inserted into the wellbore. In an embodiment, the system further includes a packer with the tubular string, the packer changeable between a retracted configuration and spaced radially inward from sidewalls of the wellbore, and a deployed configuration and radially expanded into sealing contact with the sidewalls, wherein the packer is axially adjacent an end of the annular space. In one example, an opposite end of the annular space is at a bottom of the wellbore. An embodiment of the packer includes a first packer, and wherein an opposite end of the annular space is adjacent a second packer that is in a deployed configuration. The sample tank optionally has a diameter substantially equal to a diameter of the tubular string, and a length that exceeds an axial length of the annular space. In an example, included with the system is a controller with logics that determine if criteria for a drill stem test has been met based on an analysis of the fluid and a flowrate of the fluid flowing into the annular space.

BRIEF DESCRIPTION OF DRAWINGS

Some of the features and benefits of the present invention having been stated, others will become apparent as the description proceeds when taken in conjunction with the accompanying drawings, in which.

Figure 1:
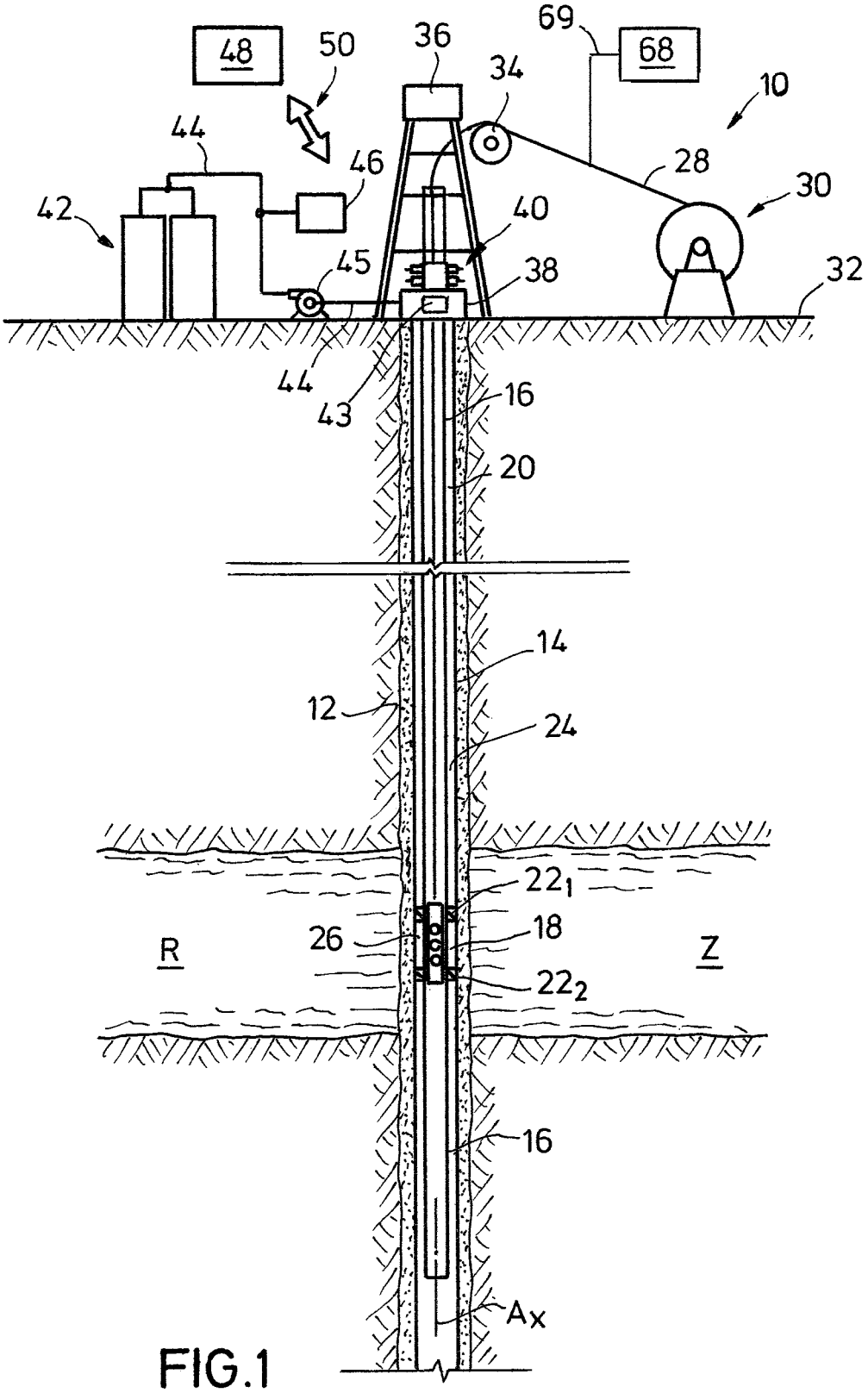
FIG. 1 is a side partial sectional view of evaluating a wellbore with an example of a wellbore sampling and testing system.

While subject matter is described in connection with embodiments disclosed herein, it will be understood that the scope of the present disclosure is not limited to any particular embodiment. On the contrary, it is intended to cover all alternatives, modifications, and equivalents thereof.

DETAILED DESCRIPTION OF INVENTION

The method and system of the present disclosure will now be described more fully hereinafter with reference to the accompanying drawings in which embodiments are shown. The method and system of the present disclosure may be in many different forms and should not be construed as limited to the illustrated embodiments set forth herein; rather, these embodiments are provided so that this disclosure will be thorough and complete, and will fully convey its scope to those skilled in the art. Like numbers refer to like elements throughout. In an embodiment, usage of the term "about" includes +/−5% of a cited magnitude. In an embodiment, the term "substantially" includes +/−5% of a cited magnitude, comparison, or description. In an embodiment, usage of the term "generally" includes +/−10% of a cited magnitude.

It is to be further understood that the scope of the present disclosure is not limited to the exact details of construction, operation, exact materials, or embodiments shown and described, as modifications and equivalents will be apparent to one skilled in the art. In the drawings and specification, there have been disclosed illustrative embodiments and, although specific terms are employed, they are used in a generic and descriptive sense only and not for the purpose of limitation.

FIG. 1 is a side partial sectional view of an example of a formation testing system 10 being used for evaluating a formation 12 that is intersected by a wellbore 14. Included with system 10 is a tubular string 16 that is shown inserted within the wellbore 12 and having an axis $A_X$. A downhole testing tool 18 is coupled with string 16 and which define a downhole string 20. Packers $\mathbf{22}_1$, $\mathbf{22}_2$ are shown included with the testing tool 18 and in a deployed configuration. In the deployed configuration packers $\mathbf{22}_1$, $\mathbf{22}_2$ span radially outward from testing tool 18 and define barriers to axial flow within an annulus 24 that is between string 20 and sidewalls of wellbore 14. An annular space 26 is formed in annulus 24 between packers $\mathbf{22}_1$, $\mathbf{22}_2$. Further in the example of FIG. 1 a string of coiled tubing 26 is shown being inserted within string 20. In the example shown coiled tubing 26 is stored on a reel 30 that is mounted on surface 32. Coiled tubing 28 is pulled from reel 30 and routed over a sheave 34 shown coupled with a derrick 36 erected above an opening of wellbore 14. A wellhead assembly 38 is shown beneath the derrick 26 and installed at the opening of wellbore 14; wellhead assembly 38 provides pressure control for the wellbore 14 and is provides a way to control fluid flow into and out of the wellbore 14. An optional blowout preventer 40 is illustrated attached on top of the wellhead assembly 38.

The example of the formation testing system 10 of FIG. 1 further includes storage tanks 42 installed on surface 32 and proximate the wellbore 14. Optional valve means 43 are schematically shown within wellhead assembly 38 provide selective communication between the coiled tubing 28 and a line 44 shown connected between the coiled tubing 28 and sample tanks 42. An optional pump 45 is provided on surface 32 for pressurizing fluid within line 44. An example of a fluid analyzer 46 is depicted in fluid communication with line 44, fluid analyzer 46 is selectively used to analyze fluids flowing within line 44. In alternatives, fluid analyzer 46 is in communication with tanks 42. In embodiments, an analysis using fluid analyzer 46 identifies components of fluid within line 44 and/or tanks 42, identifies properties and/or conditions of fluid within line 44 and/or tanks 42 (such as density, viscosity, pressure and temperature), as well as hydrocarbon content of the fluid. In examples permeability of the surrounding formation 12 is estimated or determined based on an analysis of the fluid collected in the wellbore 14 and sent to surface 32. An optional controller 48 is schematically illustrated outside wellbore 14 and which is in selective communication with fluid analyzer 46 and wellhead assembly 38 via communication means 50. Example communication means 50 include wireless, fiber optics, and conductive hardwired elements. In alternatives, analyzer 46 optionally operates continuously and provides real time results of fluid analysis, such as to controller 48.

Figure 2A:
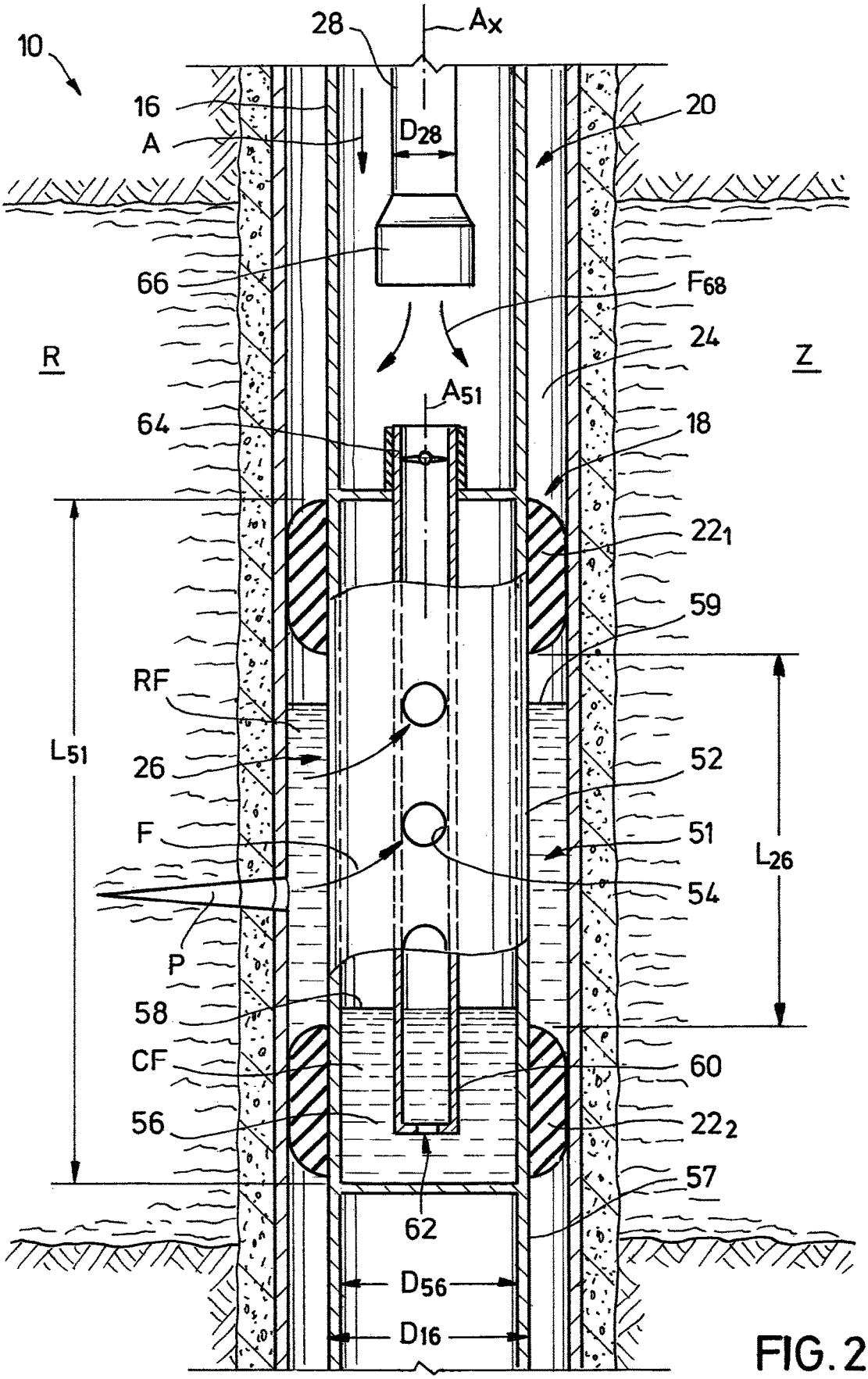
FIGS. 2A and 2B are side sectional views of example steps of drawing fluid from a sample tank of the wellbore sampling and testing system of FIG. 1.

Referring now to FIG. 2A, shown in a side partial sectional view is an example of coiled tubing 28 being lowered within wellbore 14 and in the direction of arrow A. In this example, a sample tank 51 is included within downhole string 20; sample tank 51 has an outer housing 52. Inlets 54 are depicted extending radially through housing 52 and which provide fluid communication between the annular space 26 and to a chamber 56 that is within the sample tank 51. As shown, chamber 56 has a diameter $D_{56}$ closer in value to a diameter $D_{16}$ of tubing string 16 than a diameter $D_{28}$ of coiled tubing 28. Further shown in the example of FIG. 2A is a perforation P that projects radially outward from a sidewall of the wellbore 14 and into the formation 12, and which provides an enhanced flow path of the fluid F effluent from formation 12 into the annular space 26. Optionally, a perforating sub 57 is included with the testing system 10 and within the downhole string 20. In a non-limiting example, shaped charges (not shown) are detonated from within perforating sub 57 before positioning the testing tool 18 as shown and deploying the packers $\mathbf{22}_1$, $\mathbf{22}_2$. Casing is included in the example of FIG. 2A which is shown lining wellbore 14 and being intersected by perforation P. In an alternative, wellbore 14 is open hole and without casing lining its sidewalls; further optionally, wellbore 14 is not perforated and fluid F flows into wellbore 14 from formation 12 through other means. In the example of FIG. 2A, inlets 54 are located between packers $\mathbf{22}_1$, $\mathbf{22}_2$ and are in fluid communication with received fluid RF. In an embodiment, received fluid RF is defined by fluid F having flowed from formation 12 into the annular space 26. In the example shown, the fluid F flows into wellbore 12 from within a zone Z that is within formation 12. As will be described in more detail below, received fluid RF within the annular space 26 passes through inlets 54 and is collected inside chamber 56 to define collected fluid CF. Liquid levels 58, 59 are shown illustrating example respective levels of collected fluid CF inside chamber 56 and received fluid RF inside annular space 26. Included within the sample tank 51 is a tubular standpipe 60 which extends generally along an axis $A_{51}$ of sample tank 51. An opening 62 on an end of standpipe 60 within chamber 56 is shown submerged within the collected fluid CF and on a side of liquid level 58 distal from coiled tubing 28; opening 62 allows communication to within standpipe 62 from the chamber 56.

Coiled tubing 28 is shown in the example of FIG. 2A being lowered within tubular string 16 inside the wellbore 14 for engagement with a fitting 64 shown on an uphole end of sample tank 51 and distal from packer $\mathbf{22}_2$. A coupling 66 is illustrated provided on a terminal end of coiled tubing 28 and profiled to fit onto and mate with fitting 64. In embodiments, fitting 64 is in selective communication with opening 62 and coupling 66 is in communication with coiled tubing 28; in an example, coiled tubing 28 is put into fluid communication with the collected fluid CF in the chamber 56 by engaging coupling 66 with fitting 64. In an alternative, as the coiled tubing 28 is being lowered downhole and prior to attaching fitting 66 with fitting 64, fluid $F_{68}$ from a fluid source 68 (FIG. 1) is provided into coiled tubing 28 on surface 32. Fluid $F_{68}$ flows through coiled tubing 28 downhole, exits through the coupling 66, and provides underbalance within coiled tubing 28. Fluid $F_{68}$ optionally flushes other fluids (such as drilling fluids) from within coiled tubing 28 that may have accumulated within during its descent to the downhole testing tool 18.

Figure 2B:
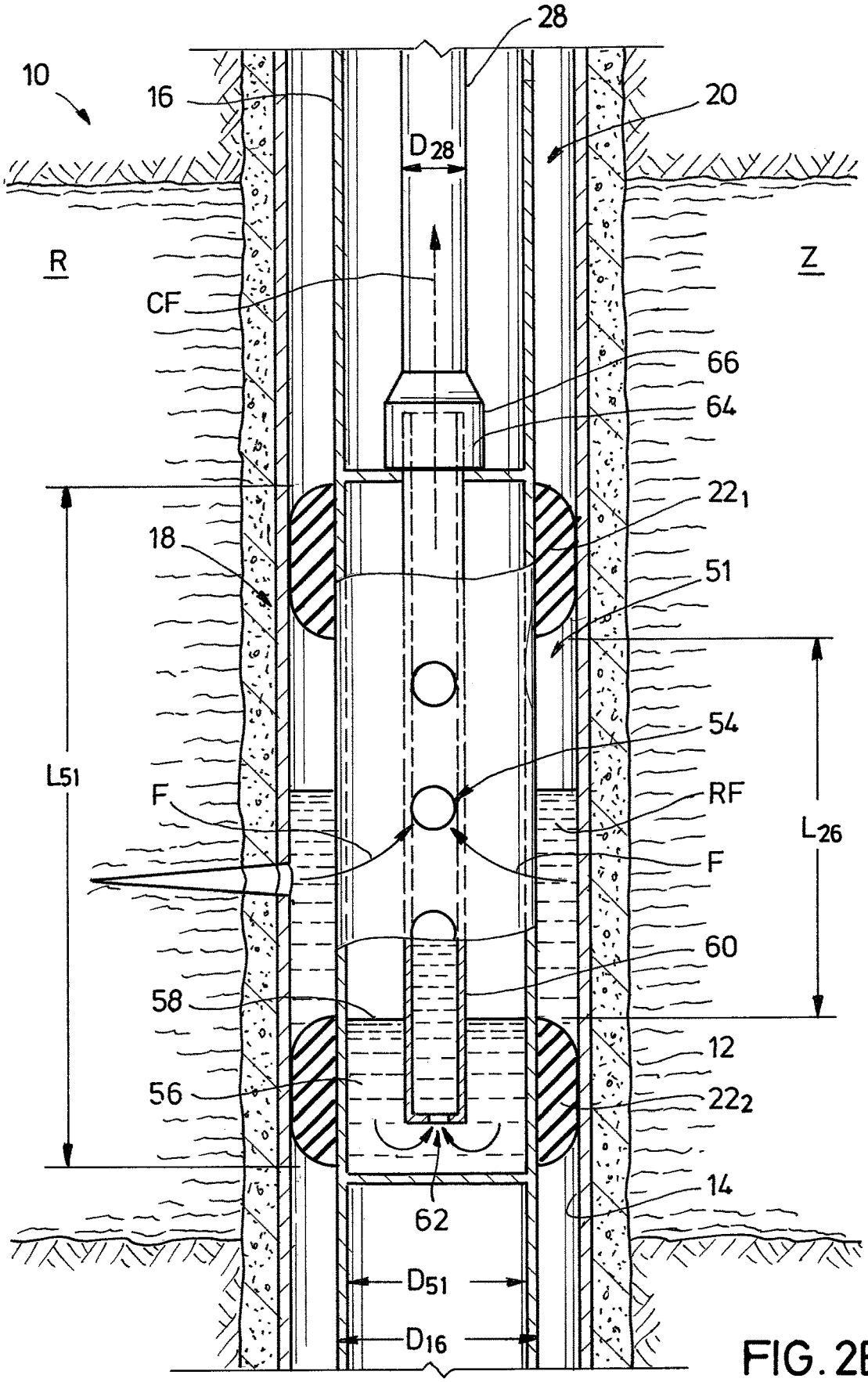

Referring to FIG. 2B, shown in side partial sectional view is an example of the coiled tubing 28 lowered to a designated depth for engaging the coupling 66 with the fitting 64; which in examples and as described above provides fluid communication between the coiled tubing and the chamber 56. Further illustrated in the example of FIG. 2B is that collected fluid CF is flowing from the chamber 56, into the standpipe 60 through the opening 62, and into the coiled tubing 28 for transport to surface 32 (FIG. 1). Shown in FIG. 2B, and as discussed above with regard to FIG. 2A, in embodiments the dimensions of chamber 56 are selectively set so a potential recovery of hydrocarbons from a reservoir R or zone Z of the formation 12 is estimated based on an analysis and/or evaluation of the collected fluid CF sampled. Unlike other well testing techniques employed to identify information about fluid F from the formation 12 surrounding the wellbore 14, such as with a reservoir characterization instrument, example volumes of the collected fluid CF are adequate to estimate hydrocarbon potential recovery. In an example a flowrate of fluid F flowing from the formation 12 into the annular space 26 is approximated based on a measurement of the volume of collected fluid CF received on surface 32, and a time period over which the fluid F flows from the formation 12 into the wellbore 14 and becomes collected fluid CF. A further advantage of reservoir evaluation is provided by capacities of the storage tanks 42 on surface 32 (FIG. 1), which allow continued emptying of the collected fluid CF from the chamber 56 so that flow of fluid F into the annular space 26, and received fluid RF into the chamber 56 is not impeded. In examples, the storage tanks 42 have capacities of up to 5 barrels, up to 10 barrels, up to 50 barrels, up to 100 barrels, more than 100 barrels, and all values between. The ability to analyze a greater volume of collected fluid CF provides a more accurate and reliable technique for estimating a capacity and/or commercial potential of the reservoir R than by limiting fluid analysis to the significantly smaller volumes afforded in known reservoir characterization devices. Analyzing a greater volume of collected fluid CF improves purity of the fluid and reduces testing inaccuracies caused by contamination such as by mud filtrate. The ability of continuous flow of fluid to the tanks 42 also requires less time and effort than the known method of filling a container downhole, withdrawing the container from downhole, and emptying the container on surface. The added volume capacity of the method and system described herein, in combination with the ability to analyze characteristics of the fluid itself, provide a greater amount of information about producing capacity of the formation 12, zone Z, and/or reservoir R than other known techniques.

Figure 3A:
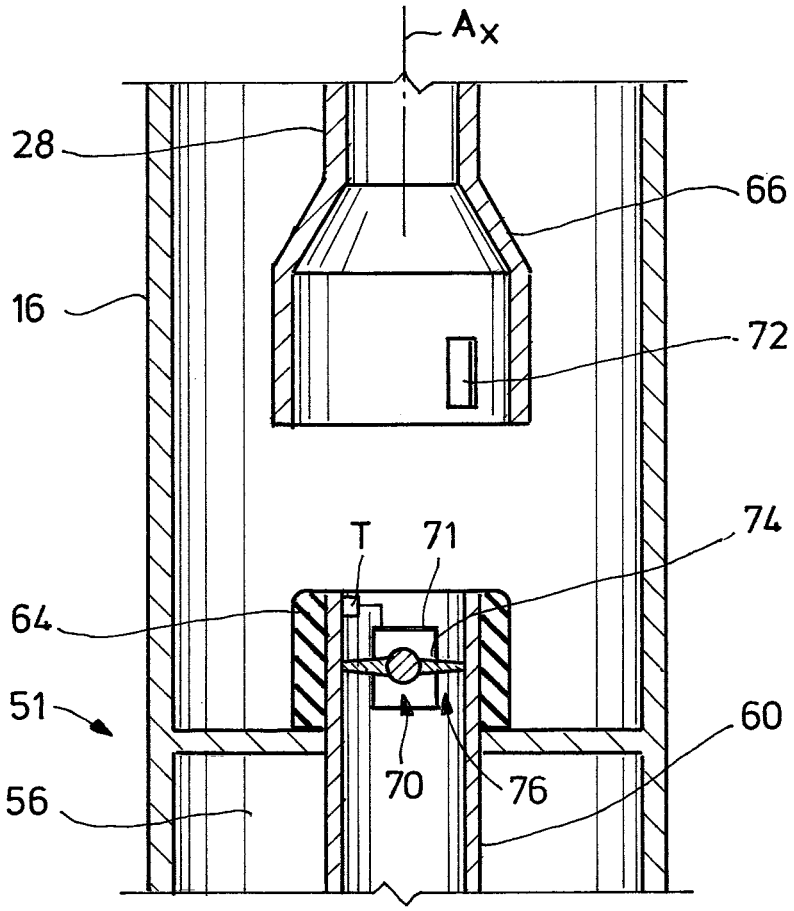
FIGS. 3A and 3B are side sectional views of an example of engaging coiled tubing with the sample tank of FIGS. 2A and 2B.
Figure 3B:
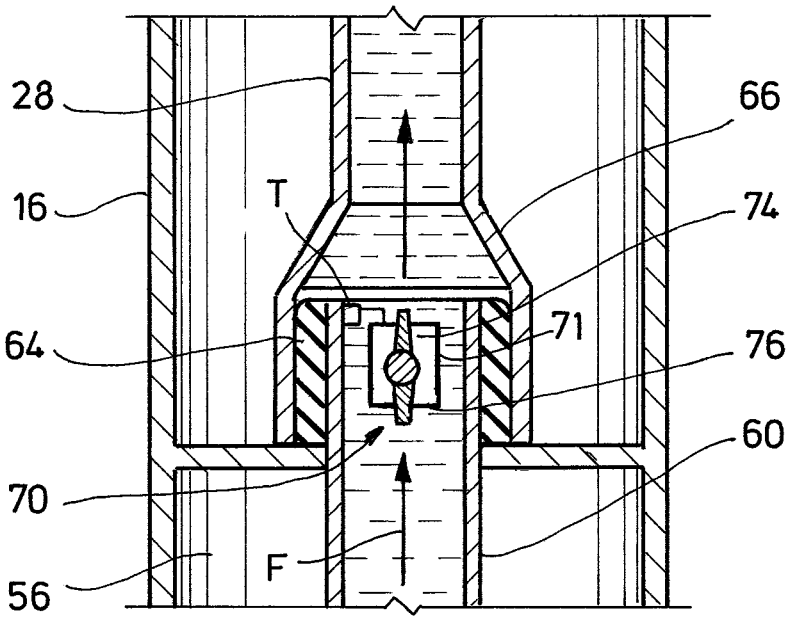

Referring now to FIGS. 3A and 3B, shown in a side partial sectional view is an example a valve assembly 70 disposed within the fitting 64 and that is selectively opened and closed to either allow or block communication through fitting 64 and with standpipe 60 within chamber 56 of sample tank 51. In the example of FIG. 3A, the valve assembly 70 is in a closed configuration which forms a barrier to fluid communication through fitting 64 and between the standpipe 60 and to within the tubular string 16. In one example of operation, valve assembly 70 selectively moves between open and closed configurations in response to pressure adjacent valve assembly 70. In an embodiment of this example, pressure adjacent valve assembly 70 is sensed by a transducer T mounted within fitting 64 between valve assembly 70 and an open end of fitting 64 facing coupling 66. Transducer T is shown in communication with an actuator 71 that is included with valve assembly 70. As described in more detail below, actuator 71 changes a configuration of valve assembly 70 (such as from an open to a closed configuration, from a closed to an open configuration, or somewhere between) based on a pressure value sensed by transducer T. In the example shown, valve assembly 70 further includes a valve member 74 that is positioned by actuator 71 to selectively block or allow access through a valve passage 76 shown extending through valve assembly 70 along a path generally parallel with axis $A_X$. In a specific example the pressure value or values sensed by transducer T are communicated to actuator 71, and within actuator 71 is control logic stored in transitory or non-transitory media, which upon receiving a signal or signals from transducer T indicating that transducer T has sensed a designated value of pressure, generates a command that causes the actuator 71 to position the valve assembly 70 into a particular configuration based on the received signal—which is based on pressure adjacent valve assembly 70. Embodiments of the actuator 71 include an electro-mechanical device, such as an electrically powered motor, a hydraulically powered system, and combinations. It is within the capabilities of one skilled in the art to determine designated opening and closing pressures, as well as creating hardware making up an actuator 71.

In embodiments a designated pressure to put the valve assembly 70 into an open configuration ("opening pressure") exceeds a designated pressure to put the valve assembly 70 into a closed configuration ("closing pressure"). As shown in FIG. 3B, the coupling 66 is engaged with the fitting 65 and that provides communication between inside of the coiled tubing 28 and inside of the fitting 64. In a non-limiting example of operation, the valve assembly 70 is put into the open configuration as shown by increasing pressure inside the coiled tubing 28 so that pressure adjacent the valve assembly 70 is at least as great as the opening pressure. In an alternative, the pressure is increased by adding a fluid (such as nitrogen) inside the coiled tubing 28, where the fluid is optionally added into the coiled tubing 28 at surface 32 (FIG. 1). In the example of FIG. 3B, pressure of fluid F within standpipe 60 is greater than the opening pressure, so that upon reconfiguring the valve assembly 70 into the open configuration the fluid F flows from within standpipe 60, through valve assembly 70, and uphole within the coiled tubing 28. In an embodiment fluid F flows continuously while valve assembly 70 is in the open configuration. An advantage of pressurizing coiled tubing 28 with a lower density fluid, such as nitrogen, lowers static head in the coiled tubing 28 that might otherwise impede fluid F flowing upwards inside the coiled tubing 28.

Referring back to FIG. 3A, in an alternative an optional profile 72 is shown provided along an inner surface of the coupling 66 for engaging a corresponding profile (not shown) included with valve assembly 70 when coupling 66 mounts with fitting 64. Engaging profile 72 with profile of valve assembly 70 selectively changes the valve assembly 70 from its closed configuration of FIG. 3A to an open configuration which allows fluid communication from standpipe 60 through the fitting 64. In an alternative, a pump (not shown) is provided within coiled tubing 28 to provide lift of the collected fluid CF through the coiled tubing 28. Examples of the valve assembly 70 include a butterfly valve, gate valve, ball valve, globe valve, and any other currently known or later developed means for selectively providing communication through fitting 64.

As discussed above, collected fluid CF flowing uphole through coiled tubing 28 is collected on surface 32 and directed into sample tanks 42. An analysis of the constituents of collected fluid CF as well as the flow of the collected fluid CF provides an estimate of the capacity and production rate from formation 12, zone Z, and or reservoir R. Based on the results of analyzing the collected fluid CF and flow rates of fluid CF a determination is made whether or not to conduct a drill stem test within wellbore 12.

Figure 4:
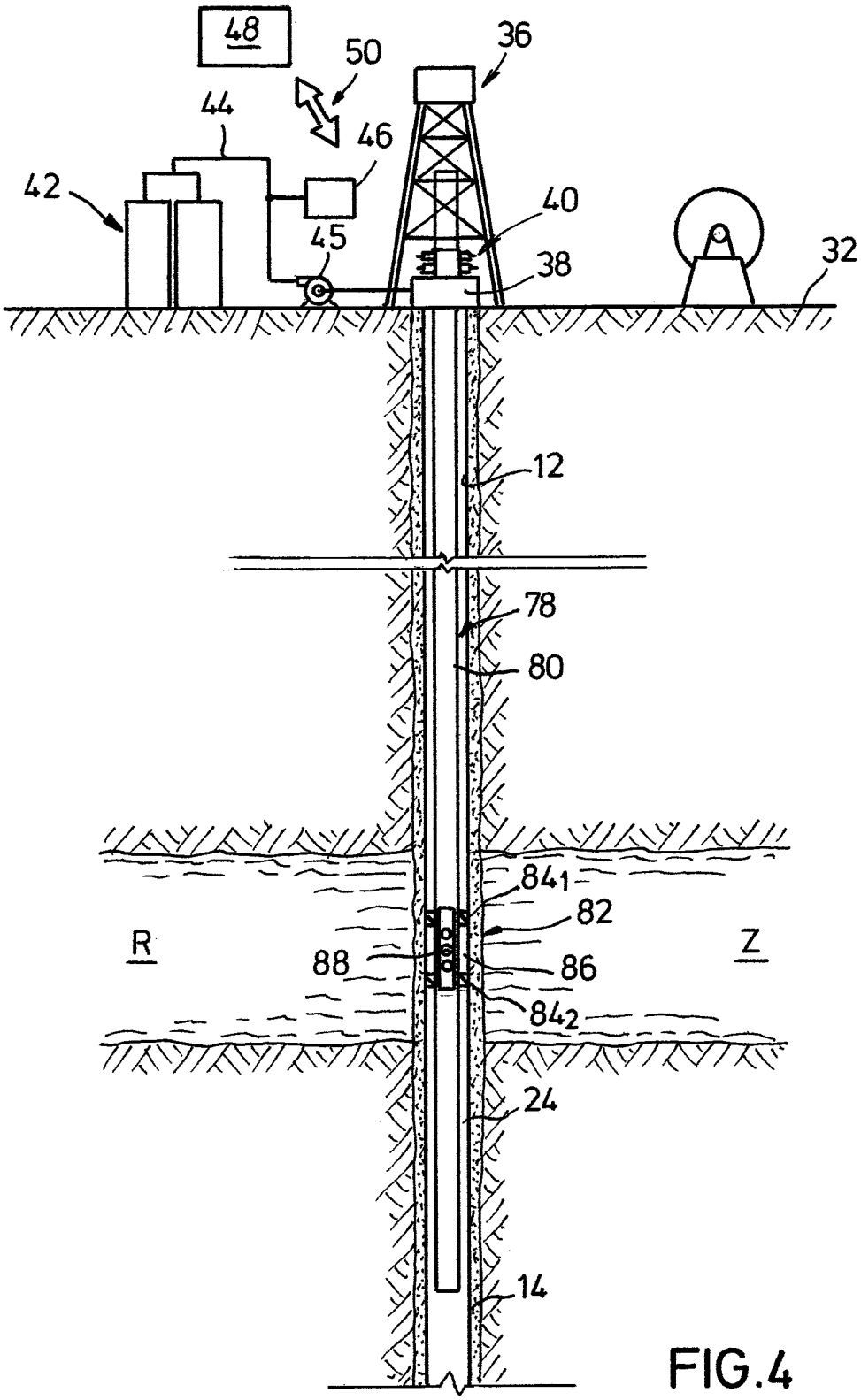
FIG. 4 is a side partial sectional view of an example of conducting a drill stem test in the wellbore of FIG. 1.

Shown in FIG. 4 is an example of conducting a drill stem test which is taking place after a determination to do so based on results of analyzing the collected fluid CF obtained through the downhole testing system 10 and as and as described above. In this example the well was classified as potentially commercial (or commercially viable) based on an analysis of the collected fluid CF. A well is considered potentially commercial if there are a sufficient amount of hydrocarbons present in the reservoir R or zone Z to justify expenditures to complete and produce the well. In examples, a magnitude or value of a sufficient amount of hydrocarbons varies and is dependent on with different factors, such as the particular well, personnel managing the wellbore operations, and well owner. The determination or a sufficient amount of hydrocarbons and/or that a well is commercial or is not commercial, is within the capabilities of one skilled in the art. Also described above is that the present system and method provides an adequate and ample amount of collected fluid CF for analysis so that in examples an evaluation of the amount of collected fluid CF indicates there is an amount of hydrocarbons within a reservoir R or zone Z so that the well is "not commercial"; that is there are insufficient hydrocarbons present in the reservoir R or zone Z to justify expenditures to complete and produce the well, A significant advantage is realized by determining a well is not commercial without the need to perform a drill stem test, which avoids the expense and time of the test itself along with that of a well completion and perforation that is typically required for a drill stem test. In the example of FIG. 4, a drill stem test system of 78 is inserted into a well bore 12, where system 78 includes a tubular string 80 of coaxial coupled tubular members. Included in string 80 is a test sub 82 having axially spaced apart packers $\mathbf{84}_1$, $\mathbf{84}_2$ that are deployed into an annulus 24 and that form an annular space 86 between string 80 and sidewalls of well bore 12. In the example, the string 80 is strategically placed within wellbore 12 so that the test sub 82 is within zone Z of formation 12 and in communication with reservoir R. Optionally, the test sub 82 is at a different depth within well bore 14. Inlets 88 are formed through a sidewall of test sub 82 and for drawing fluid flowing from formation 12 into the string 80, which is directed to surface 32 for analysis as is typical with a drill stem testing sequence.

The present invention described herein, therefore, is well adapted to carry out the objects and attain the ends and advantages mentioned, as well as others inherent therein. While a presently preferred embodiment of the invention has been given for purposes of disclosure, numerous changes exist in the details of procedures for accomplishing the desired results. Examples exist of using the present system and method in wells without or in lieu of a drill stem test, such as in a delineation or appraisal well. In embodiments the system and method in combination with existing exploration wells provides adequate testing to evaluate a formation. Additional applications of the present system and method include mapping a reservoir and expanding field boundaries. These and other similar modifications will readily suggest themselves to those skilled in the art, and are intended to be encompassed within the spirit of the present invention disclosed herein and the scope of the appended claims.

What is claimed is:

1. A method for evaluating a subterranean formation comprising:

receiving fluid that flows from a reservoir in the formation and into a wellbore intersecting the formation, and to define received fluid;

collecting the received fluid in a sample tank that is coupled with a tubular string in the wellbore, and to define collected fluid;

deploying into the wellbore an end of a string of coiled tubing having a coupling;

lowering static head in the coiled tubing to create an underbalanced environment in the coiled tubing;

providing communication between the coiled tubing and the collected fluid inside the sample tank by engaging the coupling with a fitting coupled with the sample tank;

transporting an amount of the collected fluid to outside of the wellbore through the coiled tubing;

estimating a potential recovery of hydrocarbons from the formation by identifying a constituent of the collected fluid and a flowrate of the received fluid;

determining if a drill stem test is to be conducted based on estimating the potential recovery of hydrocarbons from the formation; and if it is determined to conduct the drill stem test, then performing a drill stem test in the wellbore that comprises, placing within the wellbore a drill stem test string having a test sub with inlets that are in communication with the reservoir, drawing fluid flowing from formation through the inlets and into the test sub, directing the fluid from within the test sub to surface, and analyzing the fluid on surface.

2. The method of claim 1, wherein the flowrate of the collected fluid is estimated by measuring a volume of collected fluid received on surface and a time period over which the fluid flows from the formation into the wellbore and becomes collected fluid.

3. The method of claim 1, wherein the fluid flowing from the formation into the wellbore is received in an annular space formed between the tubular string and sidewalls of the wellbore and that is bounded by axially spaced apart packers and collected in the sample tank that is between the packers.

4. The method of claim 1, wherein the amount of the collected fluid transported to outside of the wellbore through the coiled tubing defines sampled fluid, the method further comprising storing the sampled fluid in vessels on surface.

5. The method of claim 1, further comprising perforating a sidewall of the wellbore prior to receiving fluid.

6. A method for evaluating a subterranean formation comprising:

inserting a tubular string into a wellbore that intersects the subterranean formation, the tubular string having a sample tank;

collecting fluid in the sample tank that flows from the formation into an annular space between the tubular string and sidewalls of the wellbore;

deploying into the wellbore an end of a string of coiled tubing having a coupling;

engaging the coupling with a fitting coupled with the sample tank;

opening a valve inside the fitting to put the coiled tubing into fluid communication with fluid collected inside the sample tank;

lowering static head in the coiled tubing to create an underbalanced environment in the coiled tubing;

transporting the fluid from the sample tank to outside of the wellbore through coiled tubing;

estimating a potential recovery of hydrocarbons from the subterranean formation by analyzing the fluid outside of the wellbore; and determining to conduct a drill stem test based on estimating the potential recovery of hydrocarbons, the drill stem test comprising, inserting a drill stem test string into the wellbore, sampling fluid flowing from the formation with a test sub on the test string to define sampled fluid, directing the sampled fluid to surface, analyzing the sampled fluid.

7. The method of claim 6, further comprising estimating a fluid production rate from the formation based on analyzing the fluid.

8. The method of claim 6, wherein analyzing the fluid comprises identifying components of the fluid and a flowrate of fluid flowing from the formation into the wellbore.

9. The method of claim 6, further comprising storing the fluid transported to outside of the wellbore inside storage tanks mounted on surface.

* * * * *